US006739898B1

(12) United States Patent
Ma et al.

(10) Patent No.: US 6,739,898 B1
(45) Date of Patent: May 25, 2004

(54) TELECOMMUNICATION CONNECTOR

(75) Inventors: Frank Ma, Taipei (TW); Martin Lin, Taipei (TW)

(73) Assignee: Hsing Chau Industrial Co., Ltd., Taipei (TW)

( * ) Notice: Subject to any disclaimer, the term of this patent is extended or adjusted under 35 U.S.C. 154(b) by 0 days.

(21) Appl. No.: 10/648,258

(22) Filed: Aug. 27, 2003

(51) Int. Cl.[7] ..... H01R 4/24
(52) U.S. Cl. ..... 439/404; 439/949; 439/676
(58) Field of Search ..... 439/404, 395, 439/417, 676, 941, 401, 402, 403

(56) References Cited

U.S. PATENT DOCUMENTS 5,403,200 A * 4/1995 Chen ..... 439/404
5,624,274 A * 4/1997 Lin ..... 439/417
5,975,919 A * 11/1999 Arnett et al. ..... 439/676
6,157,542 A * 12/2000 Wu ..... 439/676
6,280,231 B1 * 8/2001 Nicholls ..... 439/404
6,338,643 B1 * 1/2002 Miller et al. ..... 439/417
6,524,131 B2 * 2/2003 Schmidt et al. ..... 439/676

* cited by examiner

*Primary Examiner*—P. Austin Bradley
*Assistant Examiner*—Briggitte R. Hammond
(74) *Attorney, Agent, or Firm*—Troxell Law Office PLLC

(57) ABSTRACT

A telecommunication connector includes a housing, a circuit board mounted in the housing and holding a set of communication terminals and a set of connection terminals, the connection terminals being obliquely aligned at the circuit board in a staggered manner, reducing cross-talk, a wire block mounted on the circuit board to a communication line in connection to the connection terminals, the wire block having a guide plate in the wire hole thereof and connected between two locating walls and sloping forwardly downwards form a guide space for guiding the bare wires of the communication line into respective terminal grooves at an equal distance to ensure stable communication quality, and two movable covers pivoted to the housing and adapted to hold down the wire block and to protect the circuit board and the connection terminals against external dust.

4 Claims, 14 Drawing Sheets

TELECOMMUNICATION CONNECTOR

BACKGROUND AND SUMMARY OF THE INVENTION

The present invention relates to electrical connectors for use in a telecommunication network in which the wire block has a guide plate in the wire hole for guiding the bare wires of the communication cable into position for quick connection to the respective connection terminals without the use of a tool; movable covers are provided to hold down the wire block and to protect the circuit board and the connection terminals against external dust; the connection terminals are obliquely aligned at the circuit board in a staggered manner, increasing area of electric magnetic interaction between two terminals of a signal pair, while reducing the space between each signal pair to prevent reduce cross-talk.

A conventional network jack, as shown in FIGS. 1 and 2, comprises a housing 91, a circuit board 92, two terminal holders 93, a communication line 94, and two top caps 95. The 8 core wires 941 of the communication line 94 are respectively inserted into respective terminal slots 931 in the terminal holders 93, and crimped to respective terminals in the terminal slots 931 by a crimping tool. This design of network jack has numerous drawbacks as follows:

1. It is complicated and takes much time to crimp the core wires 941 of the communication line 94 to the respective terminals in the terminal slots 931 with a crimping tool.
2. After installation of the top caps 95 in the terminal holders 93, bottom side notches 951 of the top caps 95 are in communication with the terminal slots 931. Therefore, the top caps 95 cannot protect the terminals in the terminal slots 931 against outside dust.
3. After installation of the communication line 94, the core wires 941 respectively extend to the terminals in the terminal slots 931 at different distances, thereby affecting the communication quality.

U.S. Pat. No. 6,157,542 discloses an electric jack issued to the present inventor. This structure of electric jack is functional; however it still has minor drawbacks. It is inconvenient to connect the electric wires of the cable to the forked terminals at the terminal holder. The cross-talk prevention and dust protection of this design of electric jack is still not perfect. Further, because the holding-down caps are respectively pivoted to the terminal holder, they must be respectively turned to the locking position after installation of the cable in the terminal holder.

Therefore, it is desirable to provide a network jack that eliminates the aforesaid drawbacks.

The present invention has been accomplished under the circumstances in view. According to one aspect of the present invention, the telecommunication connector is comprised of a housing having a rear extension board, a circuit board carrying a set of communication terminals and a set of connection terminals, a wire block mounted on the circuit board to hold bare wires of a twisted pair 8-wire communication line in contact with the connection terminals respectively, and two movable covers respectively pivoted to the rear extension board of the housing and adapted to hold down the wire block at the circuit board. The bare wires of the twisted pair 8-wire communication line are inserted into a wire hole of the terminal block, keeping bare wires extended out of guide space at a distance and also keeping the front edge of the outer insulative covering of the communication cable stopped against the front sides of two locating walls of the wire block; thus the two bare wires of each twisted pair can easily be separated and respectively inserted into respective terminal grooves in the wire block.

According to another aspect of the present invention, the bare wires have approximately the same length when installed in the wire block and fastened to the respective connection terminals; therefore a high stability of communication quality is maintained.

According to still another aspect of the present invention, when the movable covers are closed, the pressure blocks impart a downward pressure to the wire block, thereby causing the bare wires to be respectively positively maintained in contact with the connection terminals. Therefore, the installation procedure is simple and labor-saving, without the use of any hand tools.

According to still another aspect of the present invention, the movable covers hold down the wire block and the communication line positively in position against vibration; the side walls, top walls and back walls of the movable covers well protect the rear extension board, the circuit board and the wire block against external dust.

According to still another aspect of the present invention, the wire block has a handle at the back side through which the user can hold the wire block with the hand conveniently during installation, and a wire clamp can be fastened to the handle and the communication line to secure the communication line to the wire block firmly in position.

According to still another aspect of the present invention, the connection terminals are obliquely aligned at the circuit board in a staggered manner, increasing area of electric magnetic interaction between two terminals of a signal pair, while reducing the space between each signal pair to prevent reduce cross-talk.

DETAILED DESCRIPTION OF THE INVENTION

Figure 1:
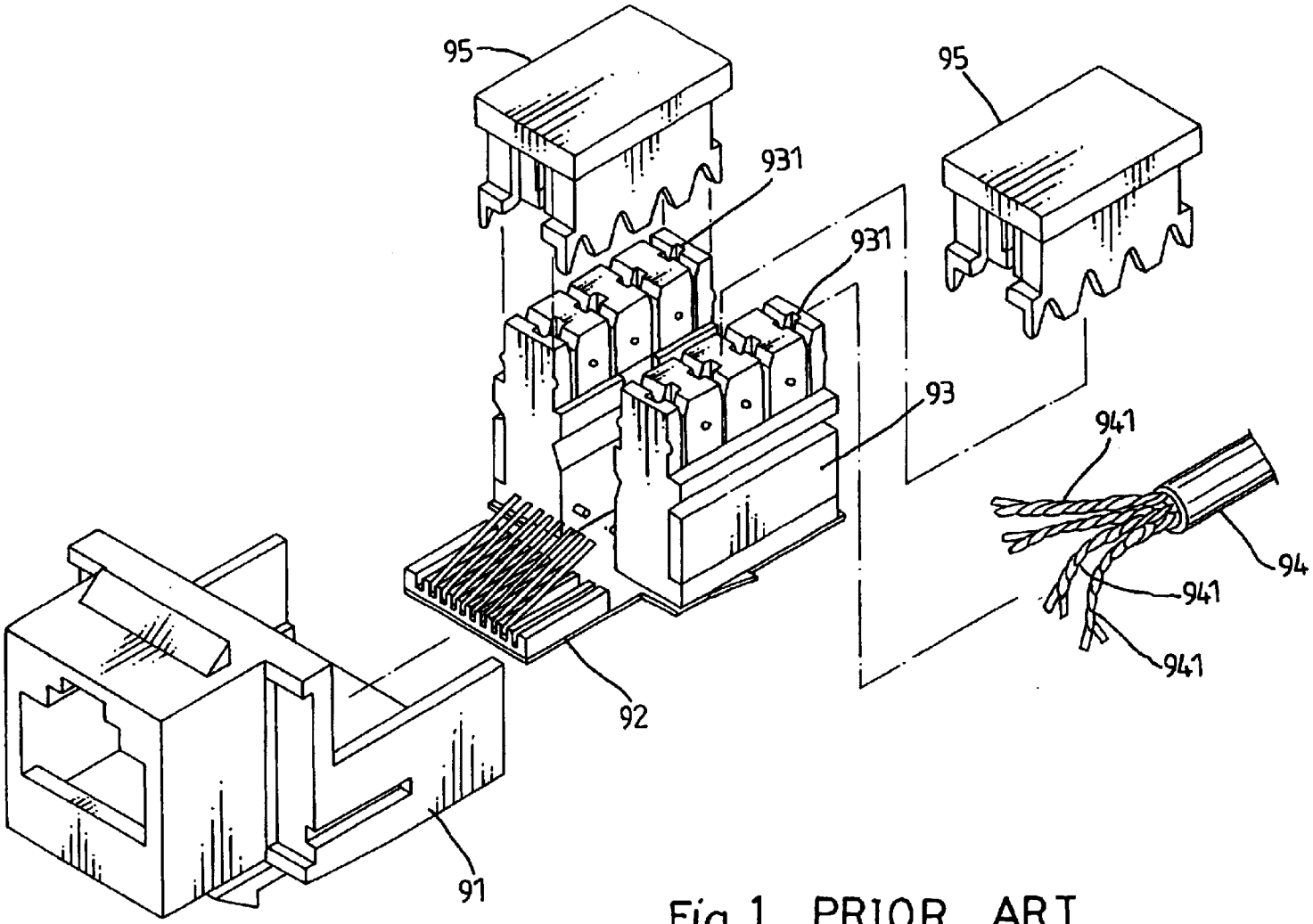
Fig. 1 PRIOR ART
FIG. 1 is an exploded view of a network jack according to the prior art.
Figure 2:
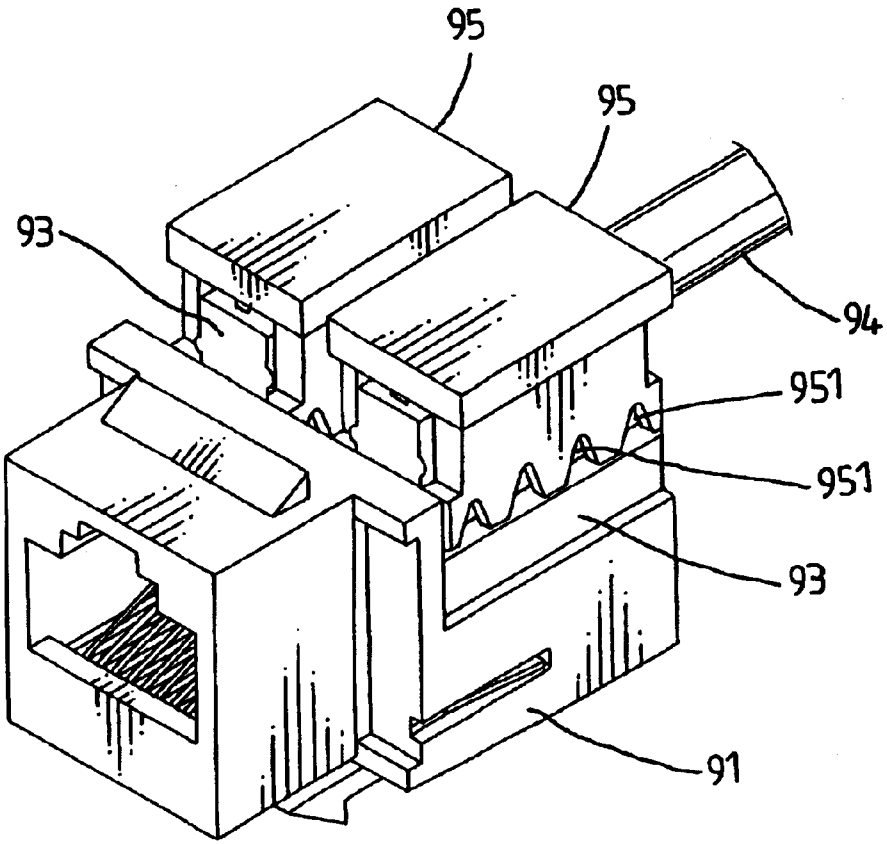
Fig. 2 PRIOR ART
FIG. 2 is an elevational assembly view of the network jack shown in FIG. 1.

Referring to FIGS. 3~14, a network jack in accordance with the present invention is shown comprising an electrically insulative housing 1, a circuit board 2, and a wire block 3.

The housing 1 has a front receiving hole 11 in the front side, a top locating block 12 at the top side above the front receiving hole 11, a plurality of bottom spring hooks 13 at the bottom side, and a rear extension board 14 backwardly extended at the back side below the elevation of the front receiving hole 11.

The circuit board 2 is mounted in the housing 1, having a plurality of communication terminals 80 arranged at a front part thereof and suspended in the front receiving hole 11 of the housing 1, and a plurality of connection terminals 7 (71,72,73,74) soldered to a rear part thereof.

The wire block 3 has two locating walls 32. The locating walls 32 each comprise a plurality of partition plates 323, 324 defining a plurality of downwardly extended slots 322 and a plurality of terminal grooves 321 in communication with the slots 322. The wire block 3 is mounted on the top side of the rear part of the circuit board 2, keeping the connection terminals 71,72,73,74 respectively inserted into the terminal grooves 321.

The main features of the present invention are outlined hereinafter. The wire block 3 comprises a wire hole 31 defined between the two locating walls 32 (see FIGS. 7 and 8), a guide plate 311 connected between the locating walls 32 and sloping forwardly downwards and separating the wire hole 31 into a front guide space 3111 and a rear guide space 3112. The bare wires 41,41' of a twisted pair 8-wire communication line 4 are inserted into the wire hole 31 of the wire block 3, keeping four bare wires 41' extended out of the front guide space 3111 at a distance and the other four bare wires 41 extended out of the rear guide space 3112 at a distance (see FIG. 9) and also keeping the front edge 40 of the outer insulative covering of the communication line 4 stopped against the front sides of the locating walls 32. By means of the support of the adjacent partition plate 323, the two bare wires 41.41' of each twisted pair are easily separated and respectively inserted into the adjacent terminal grooves 321 (see FIG. 10), and then the part of the bare wires 41,41' that projected out of the respective terminal grooves 321 is cut off (see FIGS. 11 and 12), Thus, the bare wires 41,41' and wire block 3 mounting procedure is done. Further, because the bare wires 41,41' are respectively obliquely guided out of the wire hole 31 along the guide plate 311, they are kept close to the respective wire grooves 321 for quick installation. When installed, the bare wires 41,41' have approximately the same length, assuring high stability of communication quality.

Further, the connection terminals 71,72,73,74 are obliquely aligned at the circuit board 2 in a staggered manner, increasing the space between each two adjacent connection terminals to prevent the interference of cross-talk.

Figure 3:
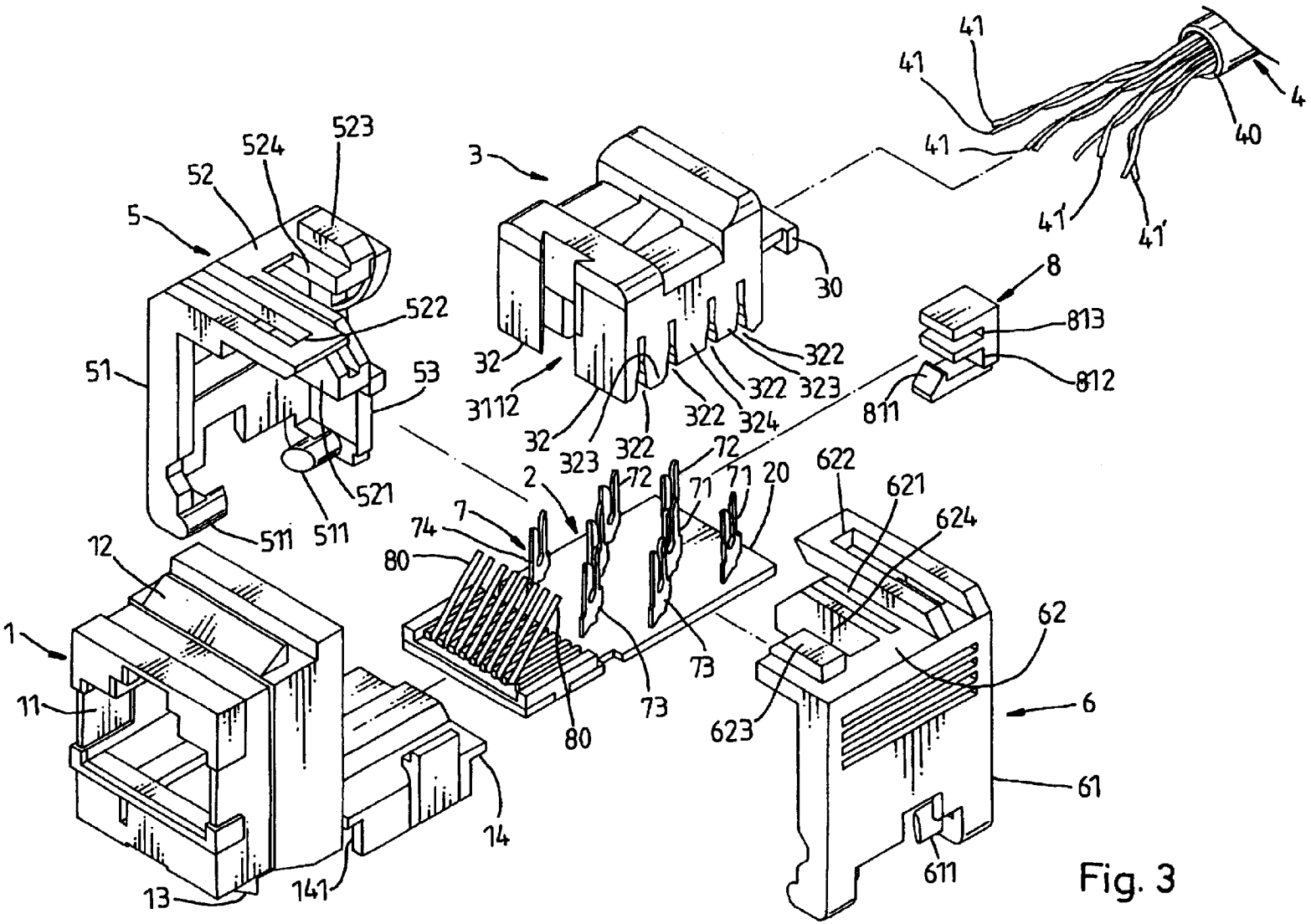
FIG. 3 is an exploded view of a network jack according to the present invention.
Figure 4:
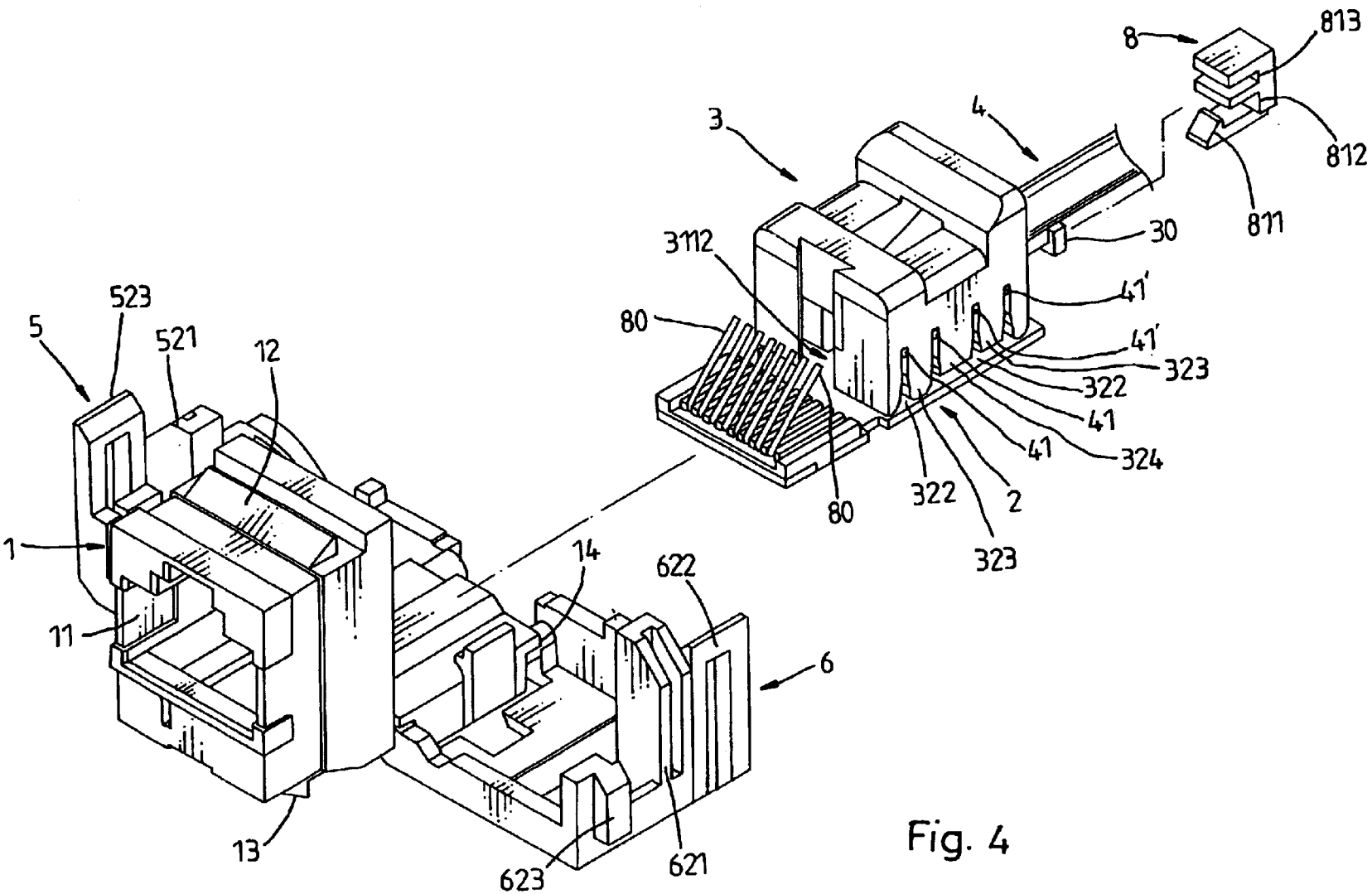
FIG. 4 is an exploded view of a part of the present invention showing the movable covers respectively pivoted to housing and the communication wire fastened to the wire block.
Figure 5:
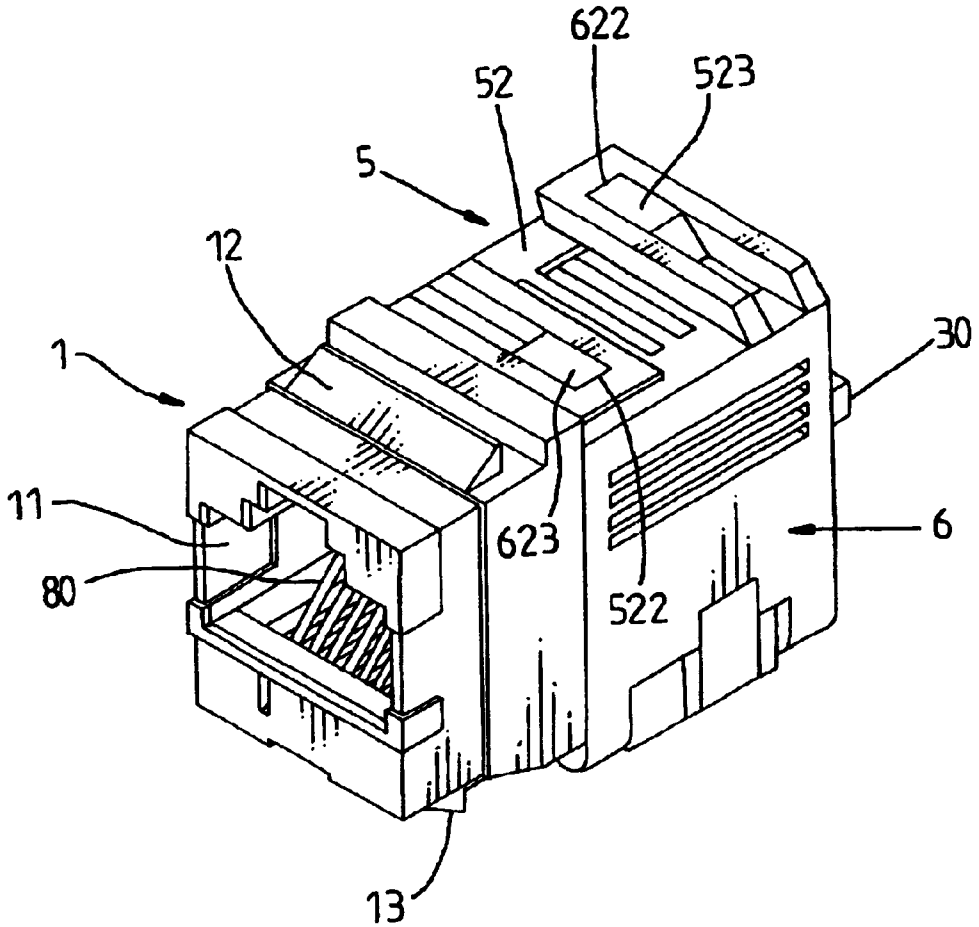
FIG. 5 is an elevational view of the network jack according to the present invention.
Figure 6:
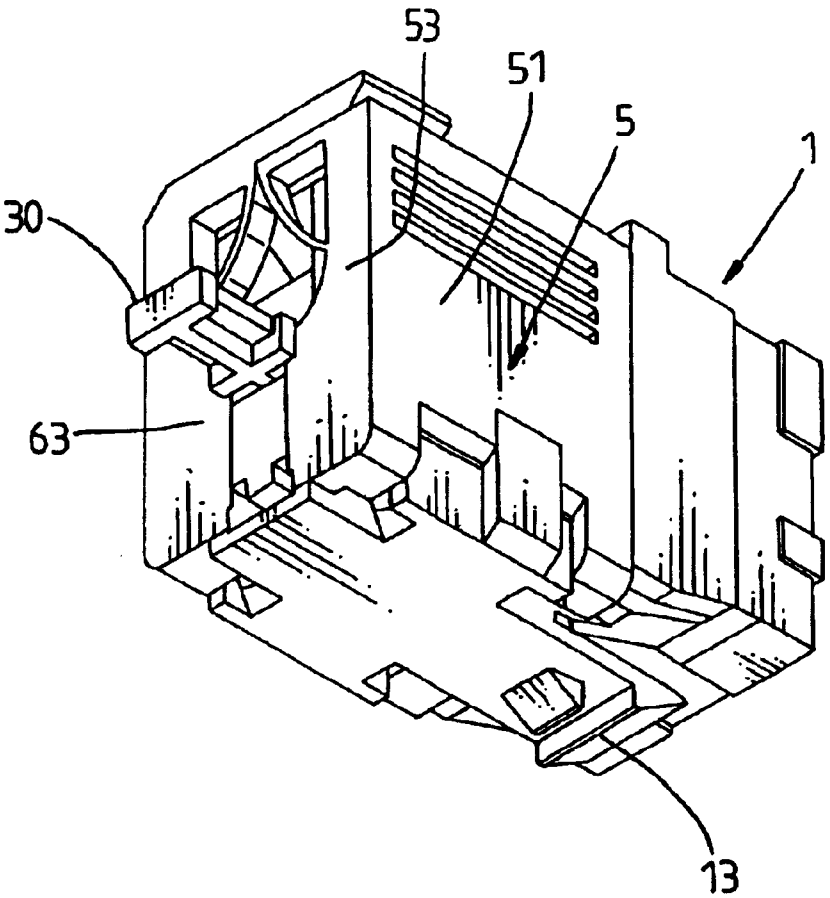
FIG. 6 is another elevational view of the network jack according to the present invention when viewed from another angle.
Figure 7:
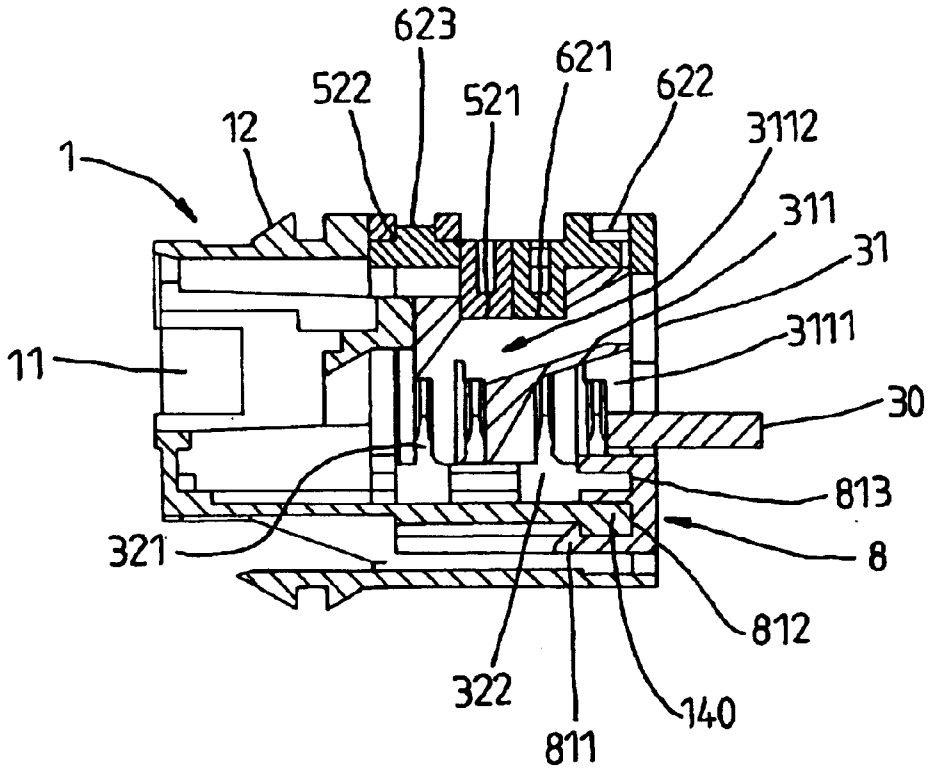
FIG. 7 is a sectional assembly view of the network jack according to the present invention.
Figure 8:
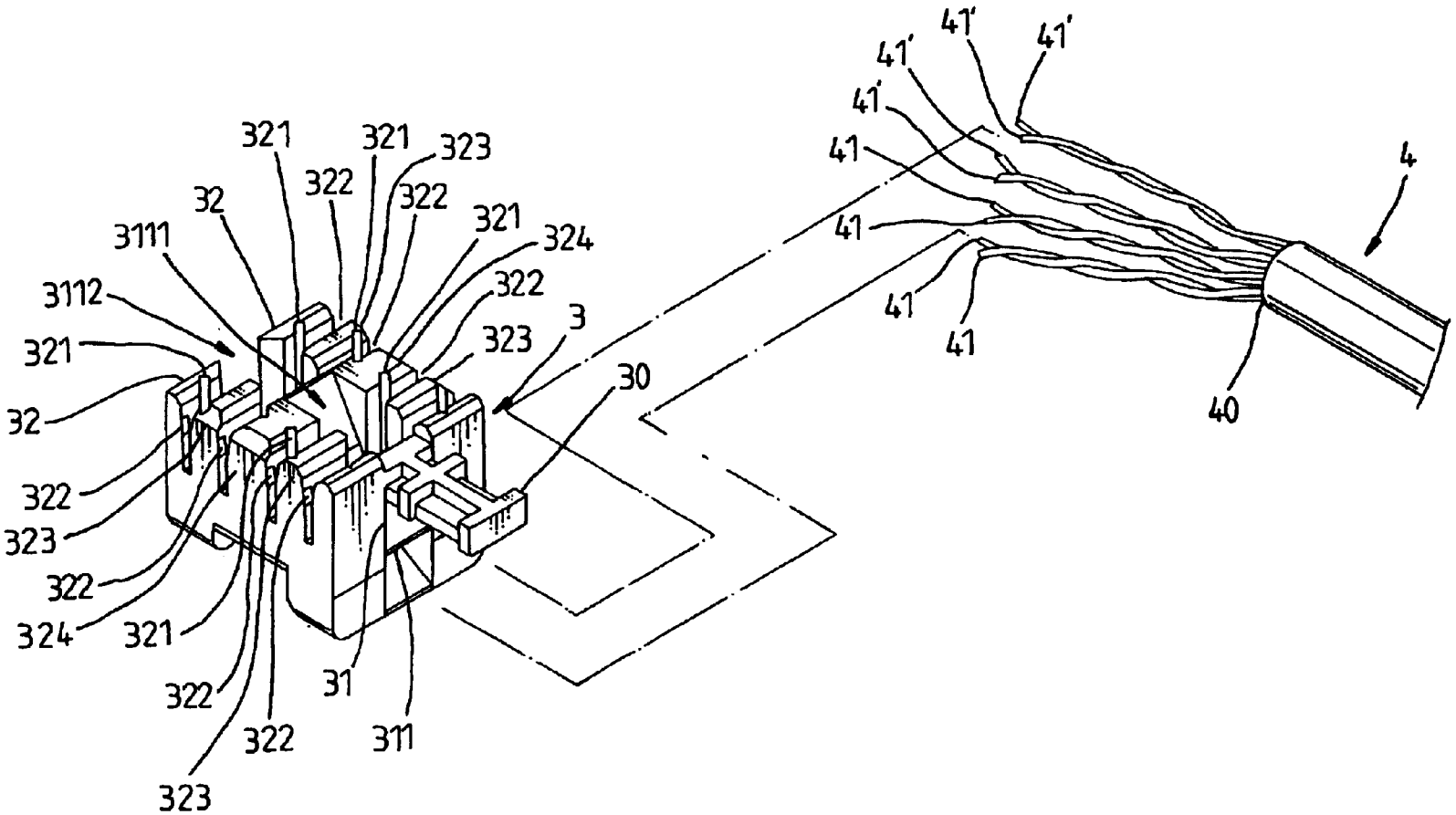
FIG. 8 is an exploded view of the wire block and the communication line according to the present invention.
Figure 9:
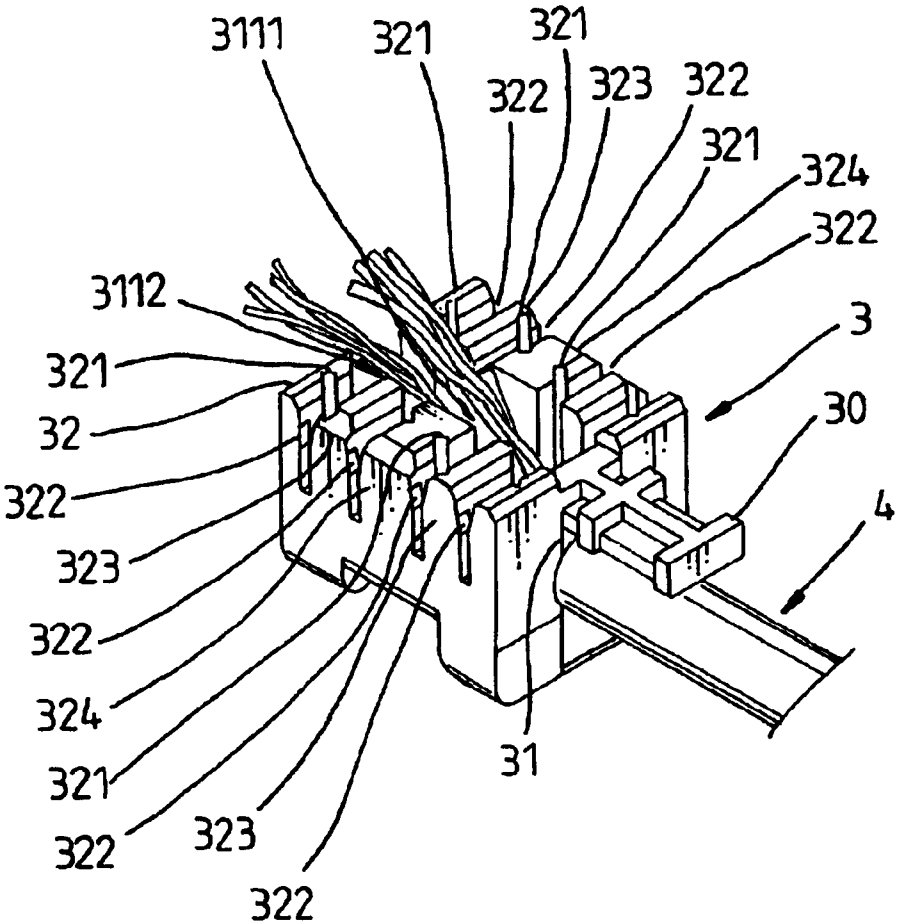
FIG. 9 is an elevational view showing the bare wires of the communication line inserted through the wire hole in the wire block and extended out of the wire block at a distance.
Figure 10:
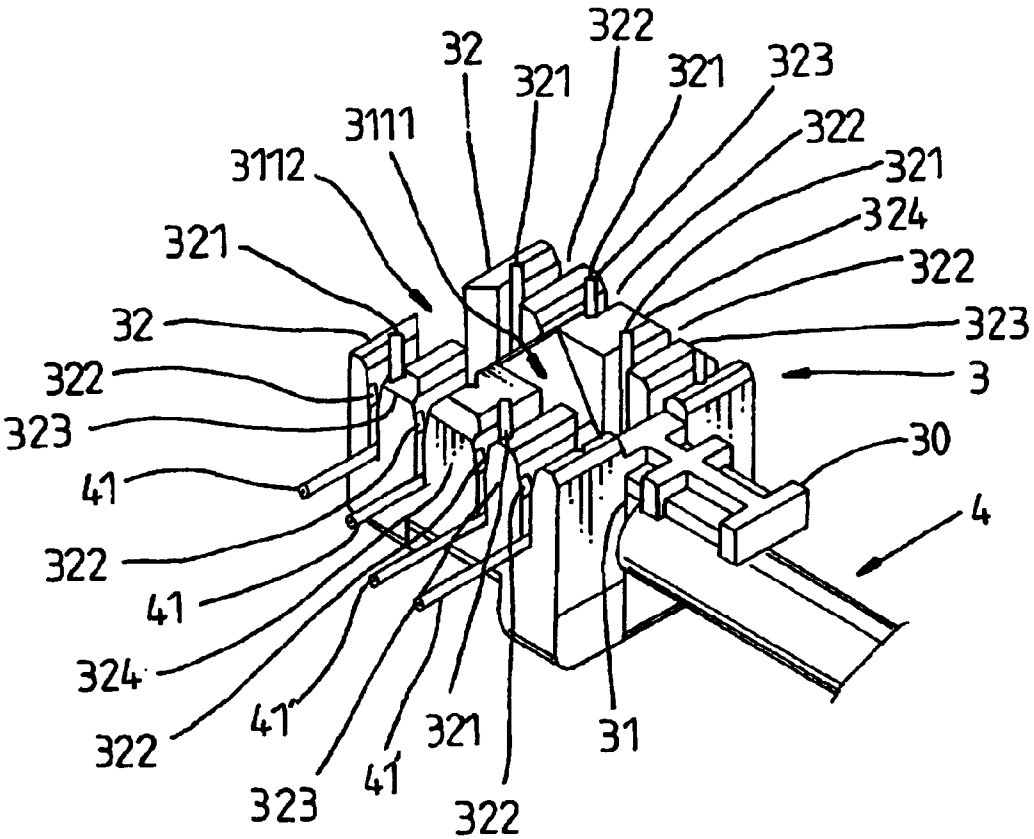
FIG. 10 is similar to FIG. 9 but showing the bare wires respectively inserted into the respective wire grooves before cutting.
Figure 11:
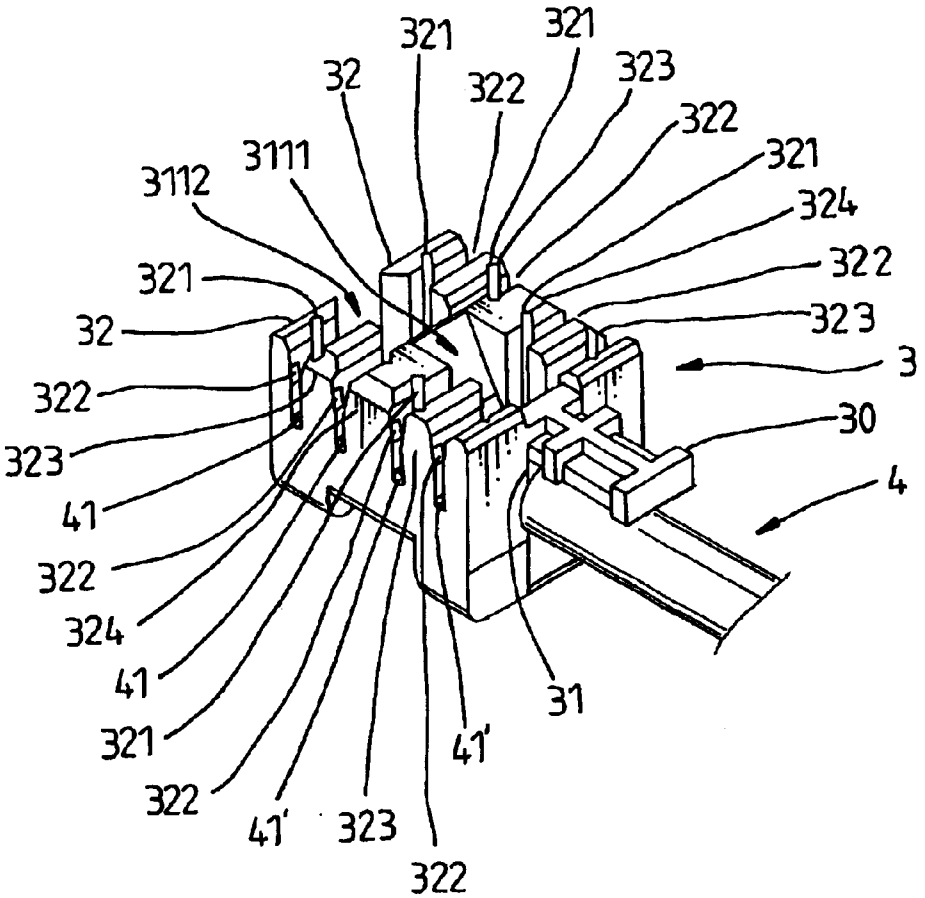
FIG. 11 is similar to FIG. 10 but showing the bare wires properly cut.
Figure 12:
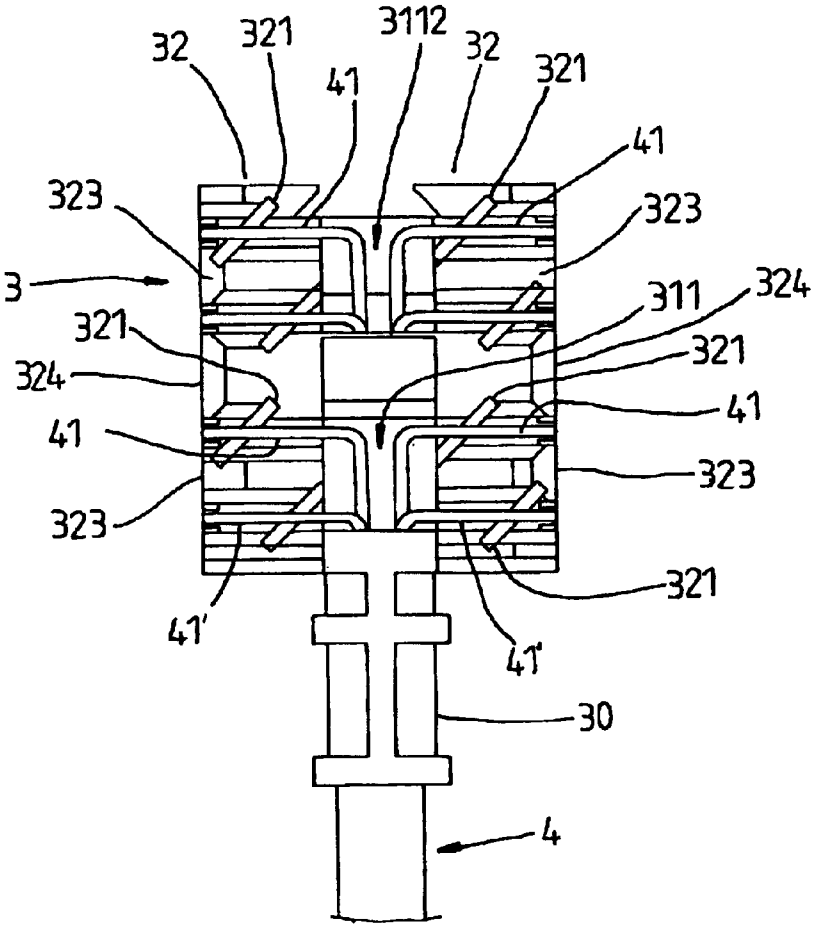
FIG. 12 is a top plain view in an enlarged scale of FIG. 11.
Figure 13:
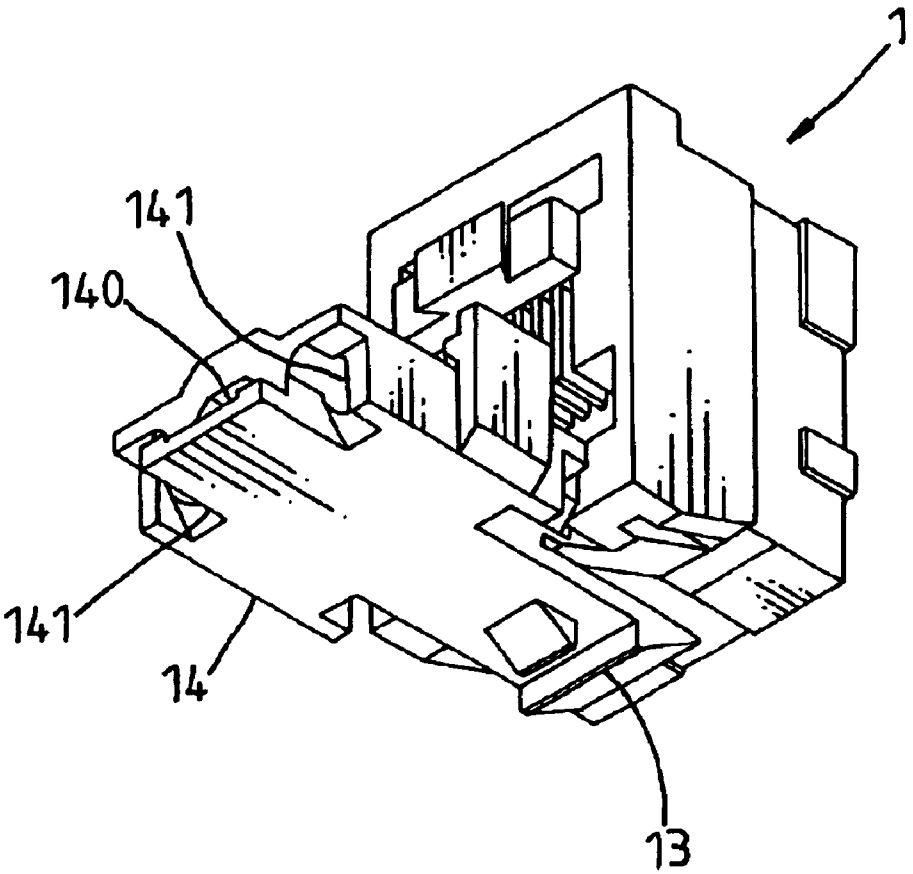
FIG. 13 is an oblique bottom elevation of the housing according to the present invention.
Figure 14:
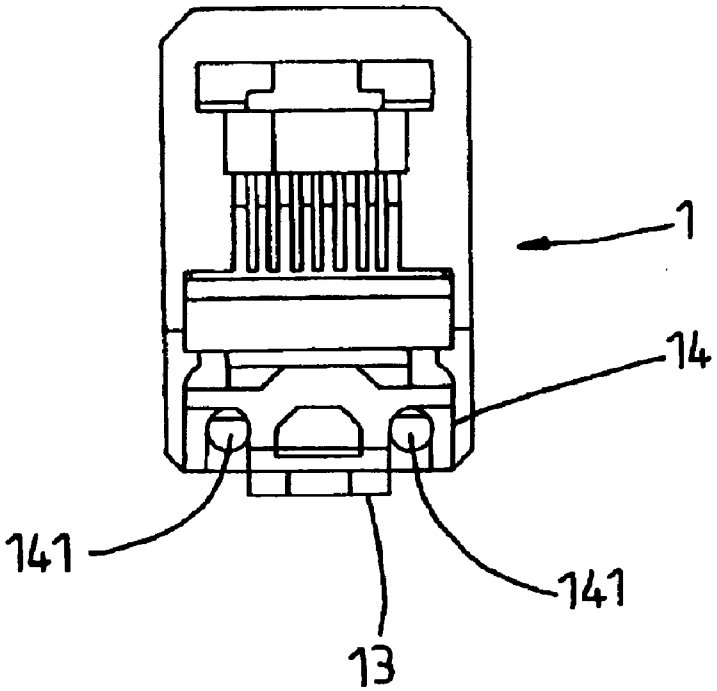
FIG. 14 is a rear plain view of the housing according to the present invention.

The rear extension board 14 of the aforesaid housing 1 comprises two pairs of pivot holes 141 symmetrically bilaterally disposed at the bottom side for the mounting of two movable covers 5,6 (see FIG. 3). The movable covers 5,6 each comprise a side wall 51 or 61, two pivot rods 511 or 611 provided at the bottom side of the side wall 51 or 61 and aimed at each other, a top wall 52 or 62, a pressure block 521 or 621 integral with the bottom surface of the top wall 52 or 62. The pivot rods 511,611 of the movable covers 5,6 are respectively pivoted to the pivot holes 141 of the rear extension board 14 of the housing 1 (see FIG. 4). After installation of the wire block 3 in the circuit board 2, the movable covers 5,6 are respectively turned inwards toward each other and covered on the wire block 3, keeping the pressure blocks 521,621 pressed on the wire block 3 to hold down the bare wires 41,41' at the connection terminals 7.

The movable covers 5,6 each further comprise a retaining hole 522 or 622 and a retaining block 523 or 623 at the top wall 52 or 62, an opening 524 or 624 at the top wall 52 or 62 corresponding to the pressure block 521 or 621, and a back wall 53 or 63 extended from the side wall 51 or 61 at one side. When the movable covers 5,6 covered on the wire block 3, the retaining hole 522 and retaining block 523 of one movable cover 5 are respectively forced into engagement with the retaining block 623 and retaining hole 622 of the other movable cover 6. Due to the presence of the opening 524 or 624 at the top wall 52 or 62 of the movable cover 5 or 6, the pressure block 521 or 621 is slightly springy. When the movable covers 5,6 closed on the wire block 3, the back walls 53,63 of the movable covers 5,6 cover the rear side of the housing 1 and the rear side of the circuit board 2.

The rear extension board 14 of the housing 1 has a locating hole 140. A clamping member 8 is provided having a bottom hook 811 hooked in the locating hole 140 of the rear extension board 14, a lower retaining hole 812, which receives the rear side of the rear extension board 14, and an upper retaining hole 813, which receives the middle part 20 of the rear side of the circuit board 2.

The wire block 3 has a handle 30 integral with the rear side for the holding of the hand during installation of the wire block 3. After installation, a wire clamp (not shown) may be fastened to the handle 30 to secure the communication line 4 in place.

As indicated above, the invention provides a network jack, which has the following advantages:

1. The bare wires 41,41' of the 8-wire communication line 4 are inserted into the wire hole 31 of the terminal block 3, keeping four bare wires 41' extended out of the front guide space 3111 at a distance and the other four bare wires 41 extended out of the rear guide space 3112 at a distance and also keeping the front edge 40 of the outer insulative covering of the communication line 4 stopped against the front sides of the locating walls 32; thus the two bare wires 41.41' of each twisted pair can easily be separated and respectively inserted into the adjacent terminal grooves 321 (see FIG. 10), and the bare wires 41,41' and wire block 3 mounting procedure is done after the part of the bare wires 41,41' that projected out of the respective terminal grooves 321 was cut off (see FIGS. 11 and 12). Therefore, the installation of the present invention is simple and time saving.
2. Because the bare wires 41,41' have approximately the same length when installed in the wire block 3 and fastened to the respective connection terminals 7, a high stability of communication quality is maintained.
3. When the movable covers 5,6 are closed, the pressure blocks 521,621 impart a downward pressure to the wire block 3, thereby causing the bare wires 41,41' to be respectively positively maintained in contact with the connection terminals 7. Therefore, the installation procedure is simple and labor-saving, without the use of any hand tools.

4. The movable covers 5,6 hold down the wire block 3 and the communication line 4 positively in position against vibration; the side walls 51,61, top walls 52,62 and back walls 53,63 of the movable covers 5,6 well protect the rear extension board 14, the circuit board 2 and the wire block 3 against external dust.

5. The handle 30 of the wire block 3 allows the user to hold the wire block 3 with the hand conveniently during installation, and a wire clamp can be fastened to the handle 30 and the communication line 4 to secure the communication line 4 to the wire block 3 firmly in position.

6. The connection terminals 71,72,73,74 are obliquely aligned at the circuit board 2 in a staggered manner, increasing the space between each two adjacent connection terminals to prevent the interference of cross-talk.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A telecommunication connector comprising:

an electrically insulative housing, said housing having a front receiving hole, a top locating block, a plurality of bottom spring hooks, and a rear extension board;

a circuit board mounted in said housing, said circuit board having a plurality of communication terminals arranged at a front part thereof and suspended in the front receiving hole of said housing, and a plurality of connection terminals fixed to a rear part thereof;

a wire block mounted on said circuit board and holding down the bare wires of a twisted pair 8-wire communication line in contact with said connection terminals respectively, said wire block having two locating walls, said locating walls each comprising a plurality of partition plates defining a plurality of downwardly extended slots and a plurality of terminal grooves in communication with the downwardly extended slots for receiving said connection terminals;

wherein:

said wire block comprises a wire holes defined between said two locating walls, a guide plate connected between said locating walls and sloping forwardly downwards and forms a guide space; the bare wires of said twisted pair 8-wire communication line are inserted into the wire hole of said wire block, keeping bare wires extended out of said guide space at a distance and also keeping a front edge of an outer insulative covering of said twisted pair 8-wire communication line stopped against front sides of said locating wall, for enabling two bare wires of each twisted pair of said twisted pair 8-wire communication line to be separated and respectively inserted into the terminal grooves of said wire block, and then a part of the bare wires that projected out of the respective terminal grooves is to be cut off.

2. The telecommunication connector as claimed in claim 1, wherein said rear extension board of said housing comprises two pairs of pivot holes symmetrically bilaterally disposed at a bottom side thereof for the mounting of said movable covers; said movable covers each comprise a side wall, two pivot rods respectively extended from said side wall and respectively pivoted to the pivot holes of said rear extension board of said housing for enabling said movable covers to be turned relative to said rear extension board of said housing between a close position and an open position, a pressure block formed integral with said top wall and adapted to press on said wire block and to further hold down the bare wires of said 8-wire communication line at said connection terminals when said movable covers turned to said close position, a retaining hole and a retaining block located on said top wall for enabling said movable cover to be engaged with each other when turned to said close position, and a back wall extended from said side wall for covering said rear extension board of said housing and said circuit board at a rear side.

3. The telecommunication connector as claimed in claim 1, wherein said rear extension board of said housing has a locating hole mounted with a clamping member to secure said circuit board, said clamping member having a bottom hook hooked in the locating hole of said rear extension board, a lower retaining hole, which receives a rear side of said rear extension board, and an upper retaining hole, which receives the middle part of a rear side of said circuit board.

4. A telecommunication connector comprising:

an electrically insulative housing, said housing having a front receiving hole a top locating block, a plurality of bottom spring hooks, and a rear extension board;

a circuit board mounted in said housing, said circuit board having a plurality of communication terminals arranged at a front part thereof and suspended in the front receiving hole of said housing, and a plurality of connection terminals soldered to a rear part thereof;

a wire block mounted on said circuit board and holding down the bare wires of a twisted pair 8-wire communication line in contact with said connection terminals respectively, said wire block having two locating walls, said locating walls each comprising a plurality of partition plates defining a plurality of downwardly extended slots and a plurality of terminal grooves in communication with the downwardly extended slots for receiving said connection terminals;

wherein:

said wire block comprises a wire holes defined between said two locating walls, a guide plate connected between said locating walls and sloping forwardly downwards and separating said wire hole into a front guide space and a rear guide space; the bare wires of said twisted pair 8-wire communication line are inserted into the wire hole of said wire block, keeping four bare wires extended out of said front guide space at distance and the other four bare wires extended out of said rear guide space at a distance and also keeping the front edge of an outer insulative covering of said twisted pair 8-wire communication line stopped against front sides of said locating wall, for enabling the two bare wires of each twisted pair of said twisted pair 8-wire communication line to be separated and respectively inserted into the terminal grooves of said wire block, and then a part of the bare wires that projected out of the respective terminal grooves is to be cut off;

said connection terminals are obliquely aligned at said circuit board in a staggered manner, increasing the space between each two adjacent connection terminals to prevent the interference of cross-talk.

* * * * *